US008453568B2

(12) United States Patent
Naoi et al.

(10) Patent No.: US 8,453,568 B2
(45) Date of Patent: Jun. 4, 2013

(54) METHOD OF MOVING PRINTING TABLES IN SCREEN PRINTING APPARATUS, AND PRINTING TABLE DRIVING UNIT THEREFOR

(75) Inventors: Naoki Naoi, Gifu (JP); Kazushi Goto, Gifu (JP); Takashi Suzuki, Gifu (JP); Motoshi Tanaka, Gifu (JP)

(73) Assignees: Tokai Seiki Co., Ltd., Gifu (JP); Tokai Shoji Co., Ltd, Tokyo (JP)

( * ) Notice: Subject to any disclaimer, the term of this patent is extended or adjusted under 35 U.S.C. 154(b) by 359 days.

(21) Appl. No.: 12/802,140

(22) Filed: May 28, 2010

(65) Prior Publication Data

US 2010/0313773 A1 Dec. 16, 2010

(30) Foreign Application Priority Data

Jun. 2, 2009 (JP) ..... 2009-132934

(51) Int. Cl.
*B41M 1/12* (2006.01)

(52) U.S. Cl.
USPC ..... 101/129; 101/126

(58) Field of Classification Search
USPC ..... 101/126, 129
See application file for complete search history.

(56) References Cited

U.S. PATENT DOCUMENTS

| | | | | |
|---|---|---|---|---|
| 3,264,889 | A * | 8/1966 | Machida et al. | 74/110 |
| 6,202,551 | B1 * | 3/2001 | Murakami | 101/123 |
| 6,595,136 | B2 * | 7/2003 | Comulada et al. | 101/485 |
| 7,726,238 | B2 * | 6/2010 | Roberts et al. | 101/123 |
| 2006/0144264 | A1 * | 7/2006 | Sakaida et al. | 101/123 |

FOREIGN PATENT DOCUMENTS

| | | |
|---|---|---|
| JP | 2007-062205 | 3/2007 |

* cited by examiner

*Primary Examiner* — Ren Yan
(74) *Attorney, Agent, or Firm* — Law Offices John A. Parrish

(57) ABSTRACT

In a screen printing apparatus, a first printing table and a second printing table are alternately driven to move horizontally between a workpiece introducing section and a workpiece printing section by a table driving unit. The table driving unit is constituted so that the first printing table is vertically moved from a first level to a second level during the horizontal movement of the first printing table, and so that the second printing table is maintained at the first level during the horizontal movement of the second printing table, whereby the first printing table can pass by the second printing table without interference therebetween when these tables meet each other. In either of the workpiece introducing section and the workpiece printing section, each of the first and second printing tables is always located at the same first level, and thus an unprocessed workpiece (W) loaded onto each of the first and second tables can be subjected to a screen printing process in the same control manner.

24 Claims, 7 Drawing Sheets

METHOD OF MOVING PRINTING TABLES IN SCREEN PRINTING APPARATUS, AND PRINTING TABLE DRIVING UNIT THEREFOR

This application claims priority to Japanese Patent Application No. 2009-132934, filed Jun. 2, 2009, the teachings of which are incorporated herein by reference in their entirety.

FIELD OF THE INVENTION

The present invention relates to moving printing tables in a screen printing apparatus. The invention further relates to moving two printing tables between a workpiece introducing section and a workpiece printing section in a screen printing apparatus for printing patterns on a workpiece such as a circuit board with paste material. The present invention further relates to a table driving unit for carrying out such a method.

BACKGROUND OF THE INVENTION

A conventional screen printing apparatus such as disclosed in Japanese Patent Document 1 below includes a machine frame which is sectioned into a workpiece introducing section and a workpiece printing section. Upper and lower printing tables are alternately moved between the workpiece introducing section and the workpiece printing section, wherein loading or unloading of a workpiece into or from the printing tables and a screen printing process of printing patterns on the workpiece can be simultaneously carried out at the workpiece introducing section and the workpiece printing section. The upper and lower printing tables are moved horizontally on rails provided at upper and lower levels for the upper and lower printing tables respectively between the workpiece introducing section and the workpiece printing section.

Patent Document 1: JP-2007-62205 A

In a conventional screen printing apparatus, the upper and lower printing tables, respectively, run on rails horizontally extending at vertically different levels without interference from each other. This means that for example, the operations of unloading of a processed workpiece, the loading of a unprocessed workpiece and the setting of the unprocessed workpiece with respect to the upper and lower printing tables are manually carried by a worker at different working levels. Those operations are troublesome to the worker, and may lay physical and mental burdens on the worker.

Even in an automated system, various operations including the loading and unloading of workpiece in the introducing section, setting of a CCD (charge coupled device) camera unit, positioning of a printing frame and a squeegee unit for aligning them with the workpiece and vertical movement of the printing frame and the squeegee unit in the printing section must be controlled in different manners with respect to workpieces set on the upper and lower printing tables from each other. This requires complex programs for a system control unit.

The present invention provides a method of alternately moving two printing tables between a workpiece introducing section and a workpiece printing section in a screen printing apparatus. The printing tables can be located at the same level in both of the workpiece introducing section and the workpiece printing section without any interference from each other during the alternate movement of the printing tables to thereby lighten the burdens on the worker and make programs for a system control unit simple.

The present invention also provides a table driving unit for executing such a method.

SUMMARY OF THE INVENTION

In a first aspect of the present invention, there is provided a method of alternately moving a first printing table and a second printing table (12) between introducing and printing sections (2 and 3) in a screen printing apparatus (P). The method employs the steps of: locating the first printing table (12) in position in the first one of the introducing and printing sections (2 and 3) at a first level; locating the second printing table (11) in position in the other section of the introducing and printing sections (2 and 3) at the same first level; moving the first printing table (12) in a horizontal direction from the first one of the introducing and printing sections (2 and 3) to the other section of the introducing and printing sections (2 and 3); and moving the second printing table (11) in a horizontal direction at the first level from the other of the two sections (2 and 3) to the first one of the introducing and printing sections (2 and 3). In the course of the movement of the first printing table (12) from the first one of the two sections (2 and 3) to the other section, the first printing table (12) is vertically moved from the first level to a second level that is different from the first level whereas the second printing table (11) is kept at the first level during the movement from the other of the two sections (2 and 3) to the first one section of the introducing and printing sections (2 and 3), so that the first printing table (12) can meet the second printing table (11) without any interference therebetween, and then is vertically moved from the second level to the first level when the first printing table (12) reaches the other section.

In this first aspect of the invention, preferably, the step of moving the first printing table (12) from the first one of the introducing and printing sections (2 and 3) to the other section of the introducing and printing sections (2 and 3) and the step of moving the second printing table (11) from the other of the two sections (2 and 3) to the first one section of the introducing and printing sections (2 and 3) are simultaneously performed.

In a second aspect of the invention, there is provided a table driving unit (10) incorporated within a screen printing apparatus that includes introducing and printing sections (2 and 3). Table driving unit (10) includes: a first printing table (12) that is located in position in one of the introducing and printing sections (2 and 3) at a first level, and that is horizontally movable from a first one of the introducing and printing sections (2 and 3) to the other section of the introducing and printing sections (2 and 3); a second printing table (11) that is located in position in the other section of the introducing and printing sections (2 and 3) at the same first level, and that is horizontally movable from the other of the two sections (2 and 3) to the first one of the introducing and printing sections while constantly keeping the first level during the horizontal movement of the first printing table (12) away from the first one of the two sections (2 and 3) to the other section of the introducing and printing sections (2 and 3). Table driving unit (10) also includes a vertical moving system (30A, 30B, 30C, 30D) that is provided for the first printing table (12) to vertically move the first printing table (12) from the first level to a second level that is different from the first level, so that the first printing table (12) can meet the second printing table (11) without any interference therebetween, and vertically move the first printing table (12) from the second level to the first level when the first printing table (12) reaches the other section of the introducing and printing sections (2 and 3).

In the second aspect of the present invention, preferably, the movement of the first printing table (12) from the first one of the introducing and printing sections (2 and 3) to the other section of the introducing and printing sections (2 and 3) and the movement of the second printing table (11) from the other of the two sections (2 and 3) to the first one section of the introducing and printing sections (2 and 3) are simultaneously performed.

In a third aspect of the invention, there is provided a table driving unit (10) for moving a first printing table (11) and a second printing table (12) between introducing and printing sections (2 and 3) in a screen printing apparatus (P), which table moving method employs a horizontal movement system (15) for moving the first and second printing tables (11 and 12) back and forth between the introducing and printing sections (2 and 3) so that the first printing table (12) is located in position in one of the two sections at a first level, and is horizontally moved from the one of the two sections (2 and 3) to the other section of the two sections (2 and 3), and so that the second printing table (11) is located in position in the other section of the two sections (2 and 3), and is horizontally moved from the other of the two sections (2 and 3) to the first one section of the two sections (2 and 3), while keeping the first level during the horizontal movement of the first printing table (12) from the one of the two sections (2 and 3) to the other section; and vertical movement guide mechanisms (30A, 30B, 30C, 30D) provided for the first printing table (12) to vertically move the first printing table (12) from the first level to a second level that is different from the first level, so that the first printing table (12) can meet the second printing table (11) without any collision therebetween, and vertically move the first printing table (12) from the second level to the first level before the first printing table (12) reaches the other section.

In the third aspect of the present invention, the movement of the first printing table (12) from the first one of the introducing and printing sections (2 and 3) to the other section of the introducing and printing sections (2 and 3) and the movement of the second printing table (11) from the other of the two sections (2 and 3) to the first one section of the introducing and printing sections (2 and 3) are simultaneously performed by horizontal movement system (15).

In the first, second and third aspects of the present invention, one of the introducing and printing sections (2 and 3) may be defined as an introducing section (2) in which a processed workpiece (W) is unloaded from each of the first and second printing tables (12 and 11) located therein, and in which an unprocessed workpiece (W) is loaded into each of the first and second printing tables (12 and 11) located therein. Also, the other section may be defined as a printing section (3) in which an unprocessed workpiece (W) loaded into each of the first and second printing tables (12 and 11) is subjected to a screen printing process.

Also, in the first, second and third aspects of the present invention, the respective first and second levels may be defined as an upper level and a lower level, with the lower level being below the upper level. Also, the vertical movement of the first printing table (11) may be defined as upward and downward movements between the upper level and the lower level.

In the table driving unit (10) according to the third aspect of the present invention, the horizontal movement system (15) may include: a drive source (16) provided in one of the introducing and printing sections (2 and 3); a drive pulley (17A) provided in the first one of the introducing and printing sections (2 and 3) and operationally connected to the driving source (16); a tension pulley (17B) provided in the other section of the introducing and printing sections (2 and 3); and an endless driving belt (18) extending between the drive and tension pulleys (17A and 17B) and driven by the drive pulley (17A). Two running sections of the endless driving belt (18) are associated with the first and second printing tables (12 and 11) respectively so as to move the first and second printing tables (12 and 11) back and forth in opposite directions to each other between the introducing and printing sections (2 and 3).

Horizontal movement system (15) may further include: at least one first table joint member (19B) securely connected to one of the running sections of the endless driving belt (18) with which the first printing table (12) is associated; a guide block member (33) securely connected to the at least one first table joint member (19B) and vertically and slidably engaged with an elongated member (36) vertically suspended from the first printing table (12); and at least one second table joint member (19A) securely connected to the other of the running sections of the endless driving belt (18) with which the second printing table (11) is associated, with the at least one second table joint member (19A) being securely connected to the second printing table (11).

In the second and third aspects of the present invention, the table driving unit (10) may include at least four vertical movement guide mechanisms (30A, 30B, 30C and 30D) provided beneath the first printing table (12). Each of the vertical movement guide mechanisms (30A, 30B, 30C and 30D) includes: a guide block member (33) securely connected to the corresponding running section of the endless driving belt (18) and having a vertical guide slot formed therein; an elongated member (36) suspended from the bottom of the first printing table (12) and slidably received in the a vertical guide slot of the guide block member (33); a cam follower (37) provided at a lower end of the elongated member (36); and a cam bar member (34) engaged with the cam follower (37) so as to cause the vertical movement of the first printing table (12) between the first and second levels during the horizontal movement of the first printing table (12) between the introducing and printing sections (2 and 3).

Preferably, the cam bar member (34) is formed with a cam groove (35), and the cam follower (37) is a roller that is engaged with the cam groove (35) of the cam bar member (34).

In the second and third aspects of the present invention, the table driving unit (10) may include vertical movement guide mechanisms (30A, 30B, 30C and 30D), wherein the first printing table (12) has a rectangular configuration, and the four vertical movement guide mechanisms (30A, 30B, 30C and 30D) are provided on the four bottom corner areas of the first printing table (12), respectively.

In the table driving unit (10) according to the second and third aspects of the present invention, the cam bar member (34) may have a cam groove (35) that includes a first flat end section (35A), a first slant section (35B) that gradually descends from the first flat end section (35A), a flat bottom section (35C) that extends from the first slant section (35B), a second slant section (35D) that gradually ascends from the flat bottom section (35C), and a second flat end section (35E) that extends from the second slant section (35D). The first printing table (12) is located at the first level when the respective cam followers (37) of the vertical movement guide mechanisms (30A, 30B, 30C and 30D) are engaged with either the first flat end sections (35A) or the second flat end sections (35E). The first printing table (12) is located at the second level when the respective cam followers (37) of the vertical movement guide mechanisms (30A, 30B, 30C and 30D) are engaged with the flat bottom section (35C).

Preferably, each of the cam grooves (35) is symmetrical with respect to an imaginary line passing through the center of the cam bar member (34).

As stated above, in the table moving method according to the present invention, during the movement of the first printing table (12) from the first one of the introducing and printing sections (2 and 3) to the other section of the introducing and printing sections (2 and 3), the first printing table (12) is vertically moved from the first level to a second level that is different from the first level, so that the first printing table (12) can meet the second printing table (11) without any collision between the two printing tables. Nevertheless, the first printing table (12) can be located at the first level in each of the introducing and printing sections (2 and 3). Thus, for example, when the first one of the introducing and printing sections (2 and 3) is employed as a workpiece introducing section (2), it is possible for a worker to manually carry out a variety of operations at the first level without changing a height of the operations such as an unloading of a processed workpiece (W), a loading of a unprocessed workpiece (W) and a setting of the unprocessed workpiece (W) with respect to each of the first and second tables (12 and 11) in the workpiece introducing section (2). Also, in the other section of the introducing and printing sections (2 and 3) which may be employed as a printing section (3), it is possible to subject an unprocessed workpiece (W) on each of the first and second tables (12 and 11) to a screen printing process in the same control manner, with the use of a variety of elements such as a printing frame (6) having a mask for printing patterns on a workpiece (W) with paste material, a squeegee unit (4) for applying the paste material to the mask of the printing frame, a CCD camera unit (7) for photographing alignment marks provided on the workpiece (W) and the mask of the printing frame, an aligning unit (5) for precisely and accurately positioning the printing frame with respect to the workpiece (W) on the first or second printing table (12 or 11) with the assistance of the CCD camera unit and so on.

In the third aspect of the present invention wherein the endless driving belt (18) is used in the horizontal movement system (15) so that the first and second printing tables (12 and 11) are associated with the two respective running sections of the endless driving belt (18) through the intermediary of the first and second table joint members (19B and 19A), it is possible to ensure the alternate and simultaneous movement of the first and second printing tables (12 and 11) between the two sections (2 and 3) without interference from each other.

In the third aspect of the present invention wherein the cam bar member (34) and the cam follower (37) are used in each of the vertical movement guide mechanisms (30A, 30B, 30C and 30D), it is preferable that the cam bar member (34) is formed with a cam groove (35), and that the cam follower (34) is defined as a roller which that is fitted into the cam groove (35) of the cam bar member (34) to enable reliable and smooth vertical movement of first printing table (12).

In the third aspect of the present invention wherein the vertical moving system includes four vertical movement guide mechanisms (30A, 30B, 30C and 30D), and wherein the first printing table (12) has a rectangular configuration, it is preferable that the four vertical movement guide mechanisms (30A, 30B, 30C and 30D) are provided on the respective bottom corner areas of the first printing table (12), to thereby enable reliable and smooth horizontal movement as well as reliable and smooth vertical movement of the first printing table (12).

In the third aspect of the present invention wherein the cam groove (34) of the cam bar member (34) includes the first flat end section (35A), the first slant section (35B) gradually descends from the first flat end section (35A), the flat bottom section (35C) extends from the first slant section (35B), the second slant section (35D) gradually ascends from the flat bottom section (35C), and the second flat end section (35E) extends from the second slant section (35D) as stated above, whereby a reliable and smooth vertical movement of the first printing table (12) can be enabled.

ADVANTAGES OF THE INVENTION

As is apparent from the foregoing, according to the present invention, although the first and second tables (12 and 11) are alternately moved at the different levels between the introducing and printing sections (2 and 3), either of the first and second tables (12 and 11) is always located at the same first level in either of the two sections (2 and 3) after the alternate movement of the first and second tables (12 and 11) is completed. Thus, when the first one of the two sections (2 and 3) is employed as the workpiece introducing section (2), the unloading of the processed workpiece (W) from each of the first and second printing tables (12 and 11), the loading of a unprocessed workpiece (W) into each of the first and second printing tables (12 and 11) and the setting of the unprocessed workpiece (W) on each of the first and second tables (12 and 11) can be manually carried out at the same first level in the workpiece introducing section (2) by a worker. Accordingly, the aforesaid operations can be performed with ease compared with the known method in which the operations have to be carried out at the different levels as stated above, so that it is possible to reduce physical and mental burdens laid on the worker during the operations. Also, in the other section of the introducing and printing sections (2 and 3) which may be employed as the printing section (3), since the unprocessed workpiece (W) set on each of the first and second printing tables (12 and 11) is located at the same first level, the unprocessed workpiece (W) on each of the first and second tables (12 and 11) can be subjected to the screen printing process in the same controlled manner, using the printing frame (6), the squeegee unit (4), the CCD camera unit (7), the aligning unit (5) and soon. Thus, control for the screen printing process is easier by the present invention compared with known method in which the screen printing process has to be controlled in the different levels.

As is apparent from the foregoing, these advantages are achieved from the fact that the first and second printing tables (12 and 11) are alternately moved at the different levels between the introducing and printing sections (2 and 3) to prevent any interference or collision therebetween, and that each of the first and second tables (12 and 11) is always located at the same first level when they reach either of the two sections (2 and 3) after the alternate movement of the first and second tables (12 and 11) is completed.

Also, according to the present invention, by employing the table driving unit (10) of the first and second printing tables (12 and 11), the horizontal movement system (15), and the vertical moving system (30A, 30B, 30C, 30D) as stated above, it is possible to smoothly and properly achieve back-and forth movement of the first and second printing tables (12 and 11) between the introducing and printing sections (2 and 3), the vertical movement of the first printing table (12) between the first and second levels to prevent any interference or collision between the first and second printing tables (12 and 11) as well as the locating each of the first and second tables (12 and 11) at the first level in either of the two sections.

Further, according to the present invention, by using the endless driving belt (18) in the horizontal movement system (15) so that the first and second printing tables (12 and 11) are associated with the two respective running sections of the endless driving belt (18) through the intermediary of the first and second table joint members (19B and 19A), it is possible to smoothly achieve the alternate and simultaneous movement of the first and second printing tables (12 and 11) between the introducing and printing sections (2 and 3) without interference from each other.

Further, according to the present invention, the roller type cam follower (34) is engaged with the cam groove (35) of the cam bar member (34), and the guide block member (33) is slidably engaged with the elongated member (36), whereby the horizontal movement of the first printing table (12) can be smoothly converted into the vertical movement thereof.

Further, according to the present invention, the four vertical movement guide mechanisms (30A, 30B, 30C and 30D) are provided on the respective bottom corner areas of the first printing table, and the cam bar members (34) are arranged so that the four vertical movement guide mechanisms (30A, 30B, 30C and 30D) are properly associated therewith, whereby the first printing table (12) for carrying the workpiece (W) can be smoothly moved horizontally and vertically between the introducing and printing section (2 and 3) while the first printing table (12) is maintained horizontally In the paragraphs entitled "SUMMARY OF THE INVENTION" and "EFFECTS OF THE INVENTION" above, although the various elements are indicated by the bracketed references for easily referring to the drawings, it should be understood that the indication is not directed to any limitation of the present invention.

BRIEF DESCRIPTION OF THE DRAWINGS

FIG. 4 (*b*) is another explanatory view for explaining the method according to the present invention, in which the upper and lower printing tables meet each other, the upper printing table being moved at the upper level while the lower printing table is moved at a lower level inferior to the upper level;

FIG. 4 (*c*) is yet another explanatory view for explaining the method according to the present invention, in which the upper and lower printing tables reach the workpiece introducing section and the workpiece printing section, respectively, and both are again located at the upper level;

DETAILED DESCRIPTION OF THE INVENTION

With reference to FIGS. 1 to 3, FIGS. 4(*a*) to 4(*c*) and FIGS. 5 to 7, an embodiment of a screen printing apparatus according to the present invention is explained below.

Figure 1:
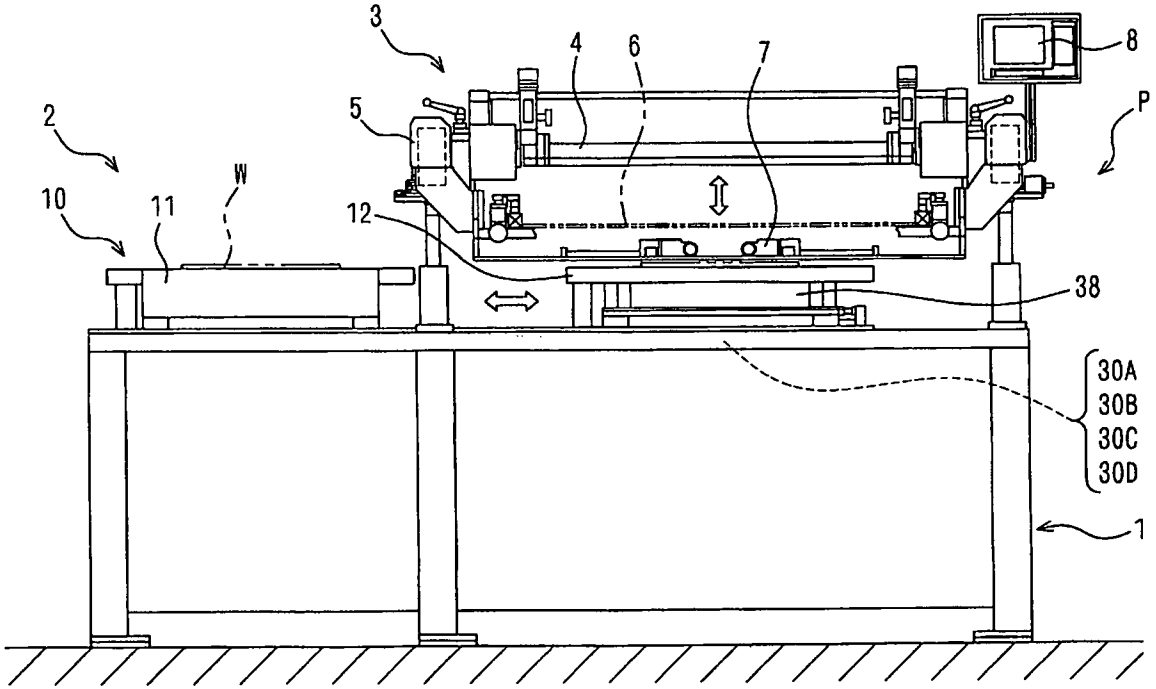
FIG. 1 is a schematic elevation view of a screen printing apparatus in which a method according to the present invention is embodied.
Figure 2:
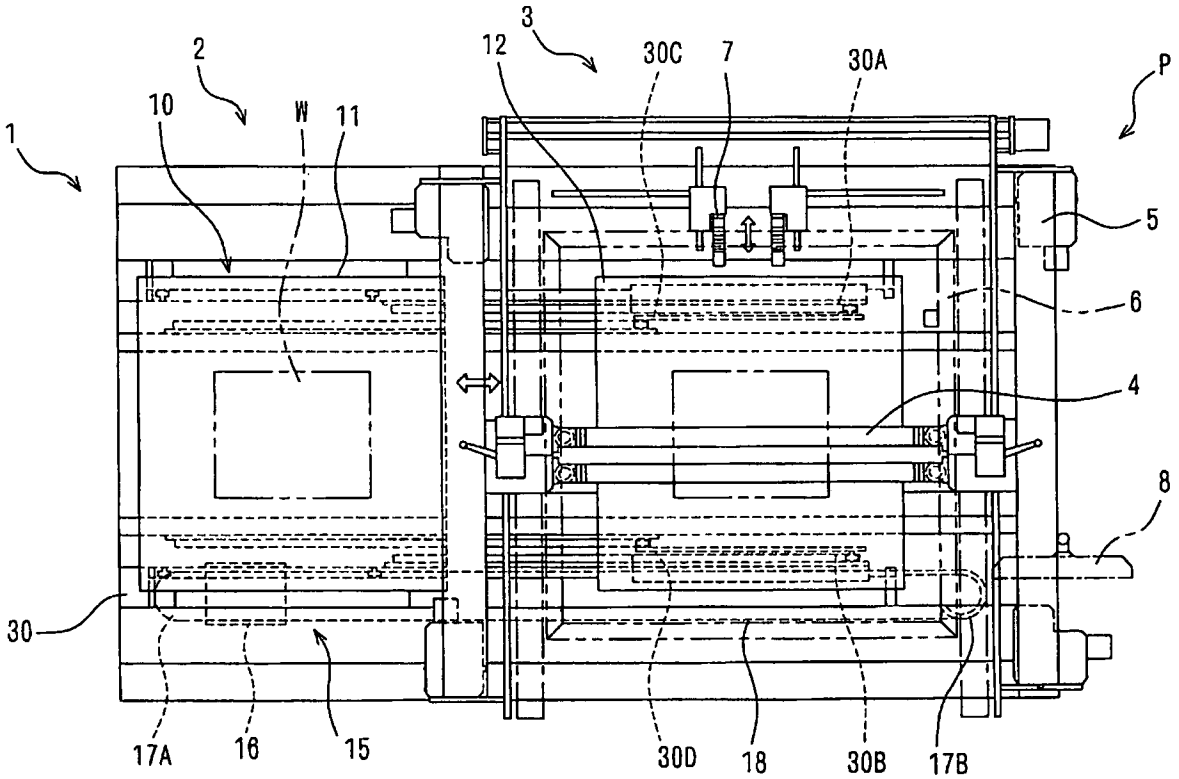
FIG. 2 is a schematic plan view of FIG. 1.
Figure 3:
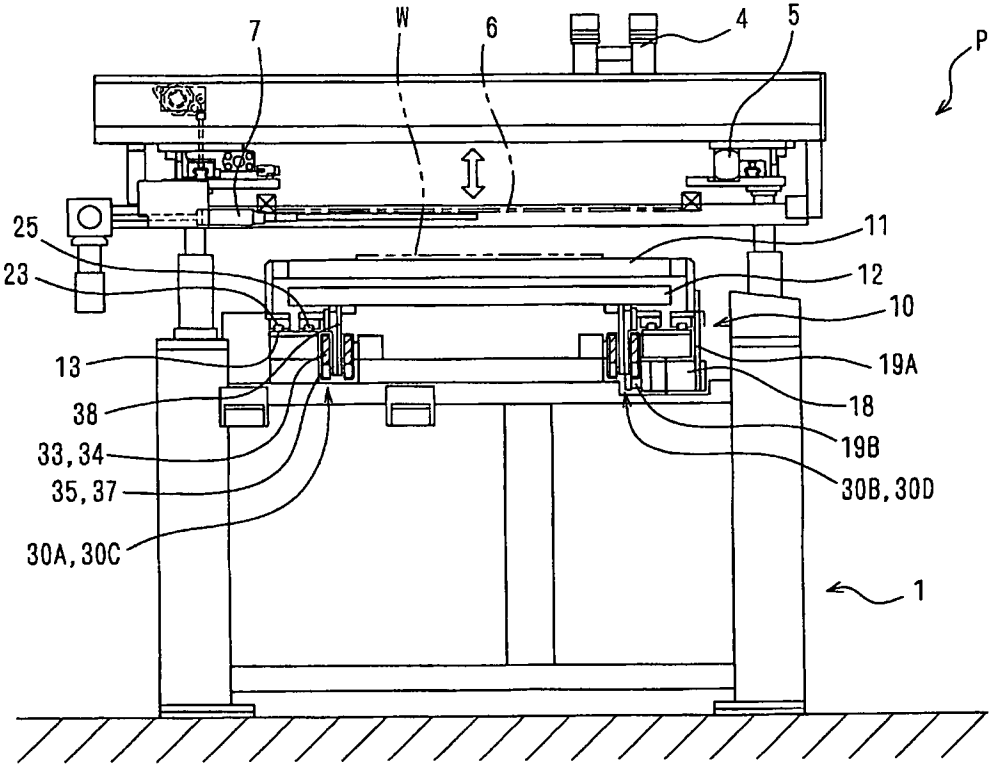
FIG. 3 is a schematic side view of FIG. 1.
Figure 5:
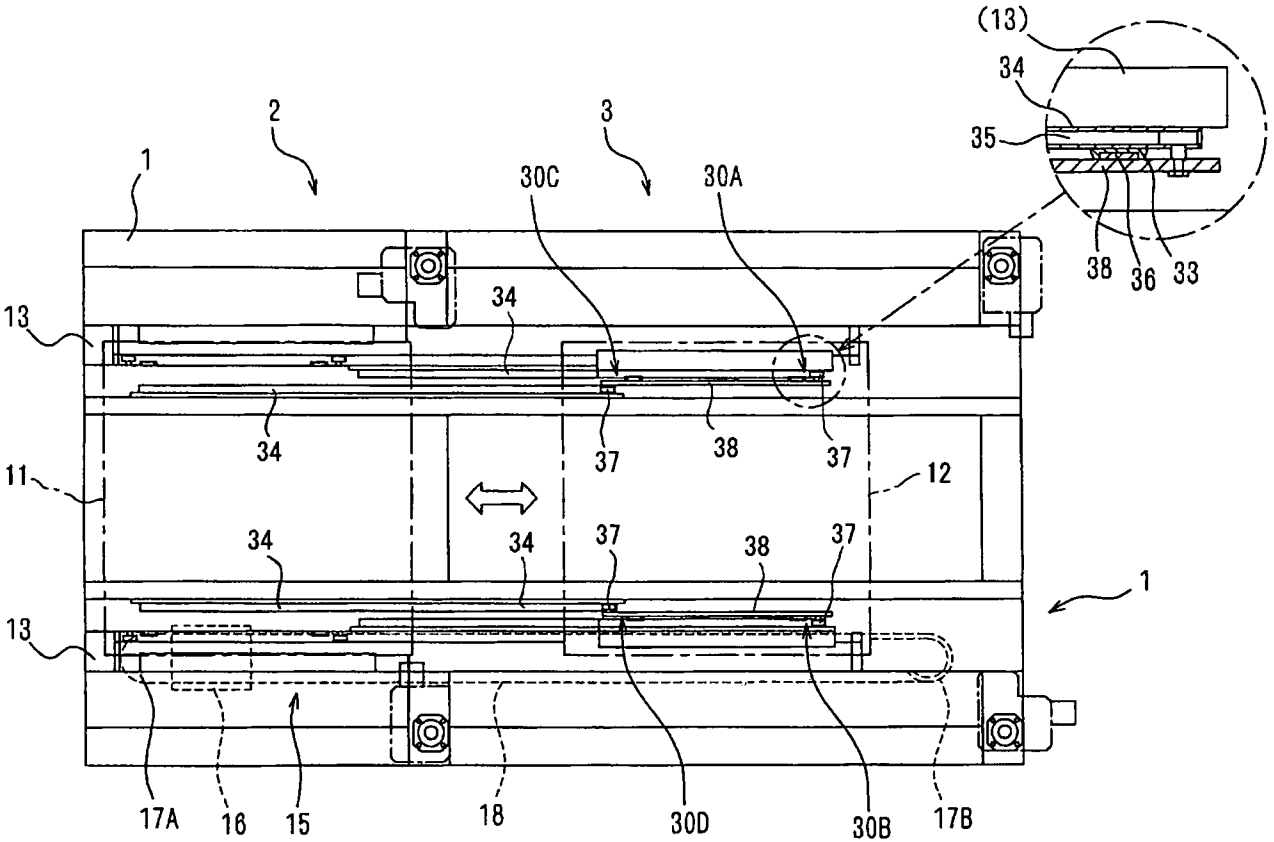
FIG. 5 is a schematic plan view similar to FIG. 2, elements for carrying out a screen printing process being eliminated therefrom.

As shown in FIGS. 1, 2 and 5, the screen printing apparatus (P), includes a machine frame 1 which is constructed from L-shaped steel members and the like. The machine frame 1 is sectioned into a workpiece introducing section 2 provided at a rear side thereof, and a workpiece printing section 3 provided at a front side thereof. An unprocessed workpiece W such as a circuit board is introduced from the workpiece introducing section 2 into the workpiece printing section 3, and a processed workpiece W is drawn from the workpiece printing section 3 to the workpiece introducing section 2. As shown in FIGS. 1 to 3, the printing section 3 is equipped with a squeegee unit 4, an aligning unit 5 and a printing frame 6. In the printing section 3, a processed workpiece W is subjected to a variety of processes in which, for example, an unprocessed workpiece W is coated with a paste material such as resin material and the like for production of a circuit board.

As best shown in FIGS. 1 to 3, a table driving unit 10 is provided on both of the introducing section 2 and the printing section 3 for alternately moving two printing tables 11 and 12 back and forth between the introducing section 2 and the printing section 3. In this embodiment, the table printing table 11 is defined employed as an upper printing table, and the printing table 12 is defined as a lower printing table. As apparent from FIG. 2, each of the upper and lower printing tables 11 and 12 is configured as a rectangular plate member which has an upper rectangular surface on which a workpiece W is securely and fixedly secured by an air-suction system (not shown).

By use of the table driving unit 10, the upper printing table 11 is horizontally moved back and forth constantly at a first level or upper level between the introducing section 2 and the printing section 3. Also, the lower printing table 12 located in position at the same level (i.e., the first or upper level) as the upper printing table 11 in each of the introducing and printing sections 2 and 3 is horizontally moved by the table driving unit 10, but it is moved back and forth at a level inferior to the first or upper level between the introducing section 2 and the printing section 3. In particular, while the lower printing table 12 is moved from one of the introducing and printing sections 2 and 3 to the other section of the introducing and printing sections (2 and 3) constantly at the same upper level, the lower printing table 12 is vertically moved at first downward from the first or upper level to a second or lower level inferior to the upper level, and then is vertically moved upward from the lower level to the upper level before the lower printing table 12 reaches the other section.

As best shown in FIGS. 2 and 5, the table driving unit 10 includes a horizontal movement system 15 for alternately moving the upper and lower printing tables 11 and 12 back and forth between the introducing section 2 and the printing section 3, and a vertical moving system that includes four vertical movement guide mechanisms 30A, 30B, 30C and 30D for vertically moving the lower printing table 12 upward and downward between the upper level and the lower level while the lower printing table 12 is moved back and forth by the horizontal movement system 15.

Figure 6:
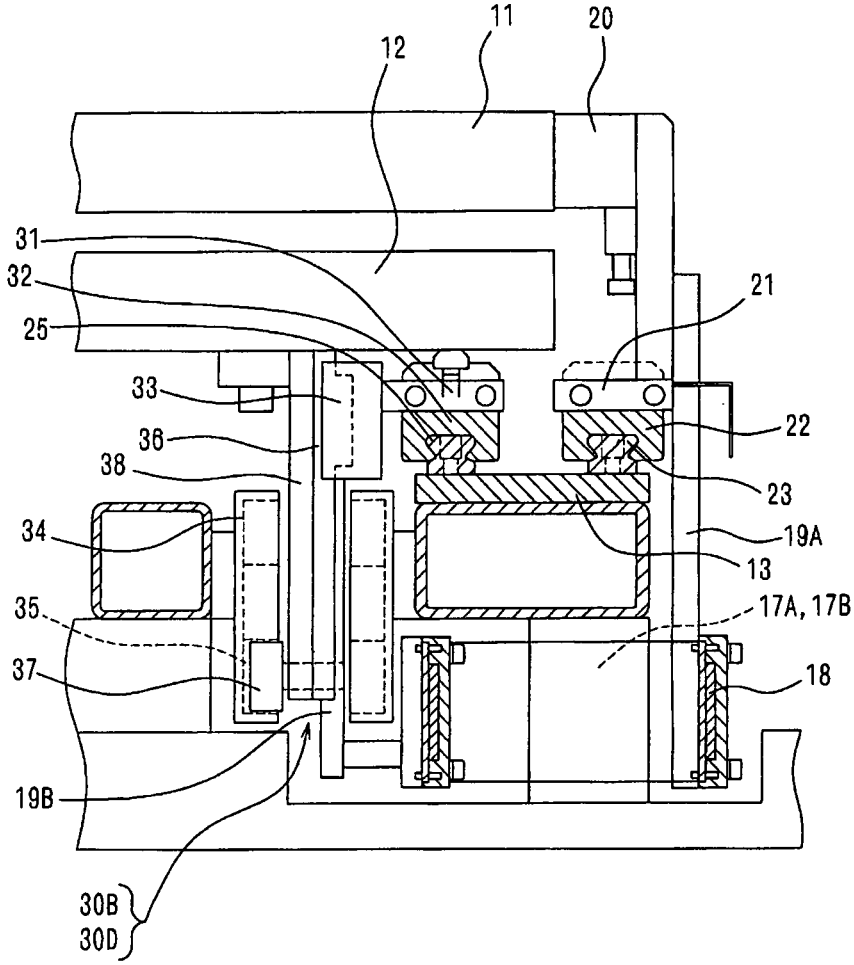
FIG. 6 is a partially enlarged view of FIG. 3.

As shown in FIGS. 3 and 6, the horizontal movement system 15 includes a pair of plate-like rail rests 13 provided in the machine frame 1 so as to extend in parallel to each other along the opposite sides of the machine frame 1 between the introducing section 2 and the printing section 3. Both the upper and lower printing tables 11 and 12 are movable back and forth along the pair of plate-like rail rests 13 between the introducing section 2 and the printing section 3, as described in detail hereinafter. The rectangular surfaces of the upper and lower printing tables 11 and 12 may be equal to each other in size and in configuration.

As best shown in FIGS. 2 and 5, the horizontal movement system 15 also includes: a drive source 16 such as an electric servomotor that is installed in the machine frame 1; a drive pulley 17A which is operationally connected to the driving source or electric servomotor 16, and which is pivotally attached to and supported by an inner side of the machine frame 1 below one of the plate-like rail rests 13 at the rear side of the introducing section 1; a tension pulley 17B that is pivotally attached to and supported by the inner side of the machine frame 1 below the aforesaid one of the plate-like rail rests 13 at the front side of the printing section 2; and an endless driving belt 18 that is horizontally entrained by the drive and tension pulleys 17A and 17B so as to extend along the inner side of the machine frame 1.

The electric servomotor 16 is controlled so as to be forwardly and reversely driven by a system control unit (not shown). For example, when the electric servomotor 16 is forwardly driven, the endless driving belt 18 rotationally runs in one of the rotational directions between the driving and tension pulleys 17A and 17B. When the electric servomotor 16 is reversely driven, the endless driving belt 18 rotationally runs in the other or reverse rotational direction. In either event, during the driving of the electric servomotor 16, the two parallel running sections of the endless driving belt 18 run in the reverse directions with respect to each other between driving and tension pulleys 17A and 17B.

As representatively shown in FIGS. 3 and 6, the horizontal movement system 15 further includes a pair of upper table joint members 19A and a pair of lower table joint members 19B which are securely connected to the respective running sections of the endless driving belt 18 for the synchronous back-and-forth movement of the upper and lower printing tables 11 and 12 between the introducing and printing sections 2 and 3.

As representatively shown in FIGS. 3 and 6, the upper printing table 11 is provided with four top-down-L-shaped joint members 20 securely attached to and suspended from the upper printing table 11 near the four corners thereof, and each of the top-down-L-shaped joint members 20 terminates with a plank member 21. Two of the four plank members 21 have respective slide shoes 22 which are slidably engaged with a rail 23 laid on one of the plate-like rail rests 13, and the remaining two plank members 21 have respective slide shoes 22 which are slidably engaged with a rail 23 laid on the other plate-like rail rest 13, as representatively shown in FIG. 3. The two top-down-L-shaped joint members 20, which are provided at the side of the endless driving belt 18, are securely connected to the respective upper table joint members 19A for the back-and-forth movement of the upper printing table 11.

Alternatively, as representatively shown in FIGS. 3 and 6, the lower printing table 12 is provided with four plank members 31 arranged under the respective corer areas thereof. Two of the four plank members 31 have respective slide shoes 32 which are slidably engaged with a rail 25 laid on one of the plate-like rail rests 13, and the remaining two plank members 31 have respective slide shoes 32 which are slidably engaged with a rail 25 laid on the other plate-like rail rest 13, as representatively shown in FIG. 3. The plank members 31 have respective pad elements on which the lower printing table 12 rests without being fixed thereon. Each of the plank members 31 has a guide block member 33 securely supported in a cantilever manner to guide the lower printing table 12 upward and downward, as stated described in detail hereinafter. The two guide block members 33, which are provided at the side of the endless driving belt 18, are securely connected to the respective lower table joint members 19B for the back-and-forth movement of the lower printing table 12.

The pair of outer rails 23 for the upper printing table 11 and the pair of inner rails 25 for the lower printing table 12 are arranged in parallel with each other so that both the upper printing table 11 and the lower printing table 12 can be synchronously moved back and forth between the introducing section 2 and the printing section.

Figure 4A:
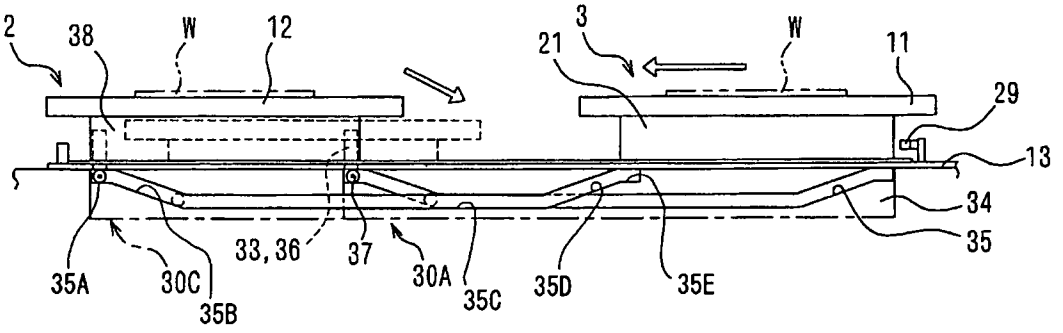
FIG. 4 (*a*) is an explanatory view for explaining the method according to the present invention, in which both of the upper and lower printing tables are located at an upper level in the workpiece printing section and the workpiece introducing section, respectively, before moving.
Figure 4B:
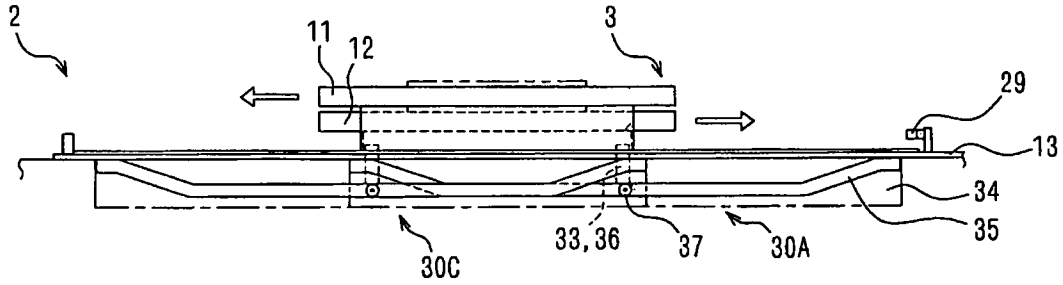
Figure 4C:
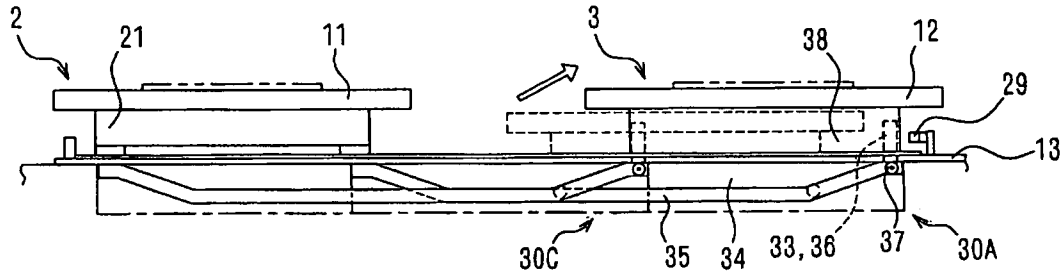
Figure 7:
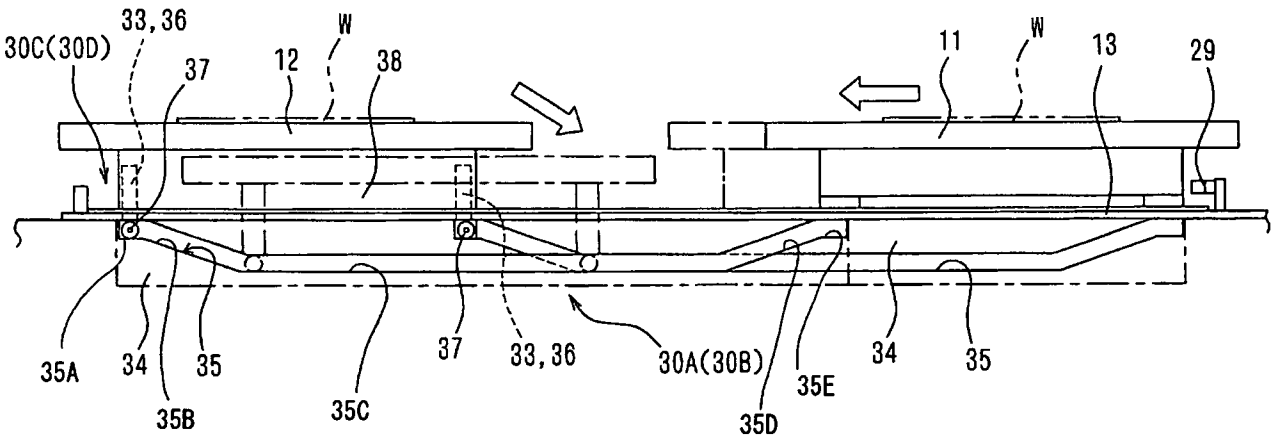
FIG. 7 is an explanatory view similar to FIG. 4(*a*) for explaining a vertical moving system comprising four vertical movement guide mechanisms for vertically moving the lower printing table upward and downward between the upper level and the lower level.

As shown in FIGS. 4 (*a*) to 4 (*c*) and in FIG. 7, in order to stop each of the upper and lower printing tables 11 and 12 at a predetermined location in each of the introducing and printing sections 2 and 3, two table stopper members 29 are provided in the rear side of the introducing section 2 and the front side of the printing section 3.

As shown in FIG. 2 and FIG. 5 with the partially-enlarged view circled by a one-dot chain, the four vertical movement guide mechanisms 30A, 30B, 30C and 30D forming the vertical moving system are provided on the respective bottom corner areas of the lower printing table 12, and the lower printing table 12 has a pair of plate members 38 suspended from and securely supported by the bottom thereof, with the plate members 38 extending in parallel with each other in the back-and-forth movement direction of the lower printing table 12. One of the plate members 38 is associated with the vertical movement guide mechanisms 30A and 30C, and the other plate members 38 is associated with the vertical movement guide mechanisms 30B and 30C.

As representatively shown in FIGS. 5 and 6, each of the vertical movement guide mechanisms 30A, 30B, 30C and 30D includes: an elongated plate-like member 36 that is securely attached to a corresponding plate member 38 so as to vertically extend, and which is slidably engaged with a vertical guide slot formed in the block member 33; a cam follower rollers 37 which is rotatably attached to the lower end of the elongated plate-like member 36; and a cam bar member 34 which is provided along a corresponding inner side of the machine frame 1, and which has a cam groove 35 formed therein, with the cam follower rollers 37 being rotatably engaged with the cam groove 35. In this embodiment, although the elongated plate-like member 36 is securely attached to the corresponding plate member 38 securely supported by the lower printing table 12, the elongated plate-like member 36 may be directly and securely supported by the lower printing table 12.

As representatively shown in FIG. 4 (*a*) and FIG. 7, each of the four cam grooves 35 includes a first flat end section 35A, a first slant section 35B descending from the first flat end section 35A, a flat bottom section 35C extending from the first slant section 35B, a second slant section 35D ascending from the flat bottom section 35C, and a second flat end section 35E extending from the second slant section 35D. Also, each of the cam grooves 35 is symmetrical with respect to a geometrical line passing through the center thereof. The four cam grooves 35 of the cam bar members 34 are identical with each another.

As best shown in FIGS. 2 and 5, the two cam bar members 34 for the vertical movement guide mechanisms 30A and 30B are arranged so as to extend from the front side of the printing section 3 to the front side of the introducing section 2, and are laterally opposed to and aligned with each other, and the cam follower rollers 37 of the vertical movement guide mechanisms 30A and 30B are rotatably received in the respective cam grooves 35 for the vertical movement guide mechanisms 30A and 30B. Similarly, the two cam bar members 34 for the vertical movement guide mechanisms 30C and 30D are arranged so as to extend from the rear side of the printing section 3 to the rear side of the introducing section 2, and are laterally aligned with each other, and the cam follower rollers 37 of the vertical movement guide mechanisms 30C and 30D are rotatably received in the respective cam grooves 35 for the vertical movement guide mechanisms 30C and 30D.

As best shown in FIG. 5, the pair of cam bar members 34 for the vertical movement guide mechanisms 30C and 30D are arranged within the pair of cam bar members 34 for the vertical movement guide mechanisms 30A and 30B, so that the former cam bar members 34 are close to the latter cam bar member 34, respectively. Thus, the distance between the cam bar members 34 for the vertical movement guide mechanisms 30C and 30D is somewhat smaller than that between the cam bar members 34 for the vertical movement guide mechanisms 30A and 30B.

As best shown in FIG. 5, the front ends of the cam bar members 34 for the vertical movement guide mechanisms 30A and 30B is spaced from the front ends of the cam bar members 34 for the vertical movement guide mechanisms 30C and 30D by a distance which is equal to the distance between the cam follower rollers 37 of the vertical movement guide mechanisms 30A and 30B and the cam follower rollers 37 of the vertical movement guide mechanisms 30C and 30D.

With the arrangement of the vertical movement guide mechanisms 30A, 30B, 30C and 30D as mentioned above, not only the lower printing table 12 is movable horizontally between the introducing section 2 and the printing section 3 along the cam bar members 34 for the vertical movement guide mechanisms 30A and 30B and the cam bar members 34 for the vertical movement guide mechanisms 30C and 30D, but also the lower printing table 12 is vertically movable upward and downward due to the engagement of the cam follower rollers 37 with the respective cam grooves 35.

For example, as shown in FIG. 7, when it is desired that the lower printing table 12 is located in position at the introducing section 2, i.e., that the four cam follower rollers 37 of the vertical movement guide mechanisms 30A, 30B, 30C and 30D rest on the respective first flat sections 35A of the guide grooves 35, the lower printing table 12 is at the same level (i.e., the upper level) as the upper printing table 11 located in position in the printing section 3. As soon as the lower printing table 12 is moved out by driving the electric servomotor 16, the table 12 goes downward due to the existence of the first slant sections 35B of the guide grooves 35. At the same time, the upper printing table 11 starts to move back to the introducing section 2 while keeping the upper level of the height.

When the lower printing table 12 is moved forward with the four cam follower rollers 37 of the vertical movement guide mechanisms 30A, 30B, 30C and 30D run on the respective flat bottom sections 35C of the guide grooves 35 at the lower level, the lower printing table 12 meets the upper printing table 11 that is moving back to the workpiece introducing section 2 while remaining at the upper level.

As soon as the four cam follower rollers 37 of the vertical movement guide mechanisms 30A, 30B, 30C and 30D reaches the second slant sections 35D of the guide grooves 35, the lower printing table 12 is moved upward. Then, the lower printing table 12 is stopped when the four cam follower rollers 37 reaches the second flat sections 35E of the guide grooves 35, i.e., when the lower printing table 12 reaches the workpiece printing section 3 at the upper level where the upper printing table 11 was located before its movement for the workpiece introducing section 2.

As stated hereinbefore, the printing section 3 is equipped with the squeegee unit 4, the aligning unit 5 and the printing frame 6 for carrying out a variety of printing processes.

As shown in FIGS. 1 to 3, the printing section 3 is further equipped with a CCD camera unit 7 for photographing alignment marks provided on a workpiece W and a mask of the printing frame 6, and a TV monitor 8 for displaying an image taken by the CCD camera unit 7. The aligning unit 5 includes an X-Y positioning mechanism and a rotationally positioning mechanism for precisely and accurately positioning the mask of the printing frame 6 with respect to the workpiece W on the upper or lower printing table 11 or 12. In particular, the aligning unit 5, including the X-Y positioning mechanism and the rotationally positioning mechanism, is suitably operated by processing images of the alignment marks taken with the CCD camera unit 7, so that the precise and accurate positioning of the printing frame 6 with respect to the workpiece W can be performed. Then, the printing frame 6 is moved downward so that the printing frame 6 is applied to the workpiece W. Then, the squeegee unit 4 is moved downward to the printing frame 6, and is driven so that patterns are printed in place on the workpiece W with paste material such as resist ink, symbol ink, masking ink, cream solder or the like. After the printing of the pattern on the workpiece W is completed, the squeegee unit 4 and the printing frame 6 are moved upward to predetermined positions, respectively.

With reference to FIGS. 4 (*a*), 4 (*b*) and 4 (*c*), an operation of the screen printing apparatus P is described below.

As shown in FIG. 4 (*a*), where it is desired that the lower printing table 12 on which an unprocessed workpiece W is set is located in position in the introducing section 2, and that the upper printing table 11 on which a processed workpiece W is se, is located in position in the printing section 3, and when the electric servomotor 16 is forwardly driven so that the endless belt 18 of the horizontal movement system 15 of the table driving unit 10 rotationally runs in the forward direction between the driving and tension pulleys 17A and 17B, the respective upper and lower printing tables 11 and 12 are simultaneously moved backward and forward in opposite directions to each other, respectively. Thus, the upper printing table 11 is moved at the upper level from the printing section 3 toward the introducing section 2. On the other hand, while the lower printing table 12 is moved from the introducing section 2 toward the printing section 3, the lower printing table 12 is gradually moved downward from the upper level to the lower level due to the first slant sections 353 of the guide grooves 35 of the guide bar members 34. After the lower printing table 12 has reached the flat bottom sections 35C of the guide grooves 35 of the guide bar members 34, the lower printing table 12 is horizontally moved toward the printing section 3 at the lower level.

As shown in FIG. 4 (*b*), although the lower printing table 12 meets the upper printing table 11 at a location between the introducing section 2 and the printing section 3, the lower printing table 12 moving at the lower level can pass by the upper printing table 11 moving at the upper level without any collision therebetween.

As shown by the broken lines in FIG. 4 (*c*), after the lower printing table 12 has reached the second slant sections 35D of the guide grooves 35 of the guide bar members 34, the lower printing table 12 is gradually moved upward from the lower level toward the upper level. Then, when the lower printing table 12 has reached the second flat sections 35E of the guide grooves 35 of the guide bar members 34, i.e., when the lower printing table 12 is moved upward to the upper level, the driving of the electric servomotor 15 is halted so that the lower printing table 12 is stopped at the upper level in the printing section 3. Simultaneously, the upper printing table 11 is stopped in the introducing section 2.

Thereafter, the aligning device 5 is driven with the assistance of the CCD camera unit 7 so that the printing frame 6 is precisely and accurately positioned with respect to the unprocessed workpiece W set on the lower printing table 12, and the printing frame 6 is moved downward so that the printing frame 6 is applied to the workpiece W set on the lower printing table 12. Next, the squeegee unit 4 is moved downward to the printing frame 6, and is driven so that patterns are properly printed in place on the workpiece W with paste material such as resist ink, symbol ink, masking ink, cream solder and the like. After the printing of the pattern on the workpiece W is completed, the squeegee unit 4 and the printing frame 6 are moved upward to the predetermined positions, respectively.

While the screen printing process is carried out in the printing section 3 as mentioned above, in the introducing section 2, the processed workpiece W is unloaded from the upper printing table 11, and then an unprocessed workpiece is loaded into and set on the upper printing table 11.

Then, the electric servomotor 16 is reversely driven so that the endless belt 18 of the horizontal movement system 15 of the table driving unit 10 rotationally runs in the reverse direction between the driving and tension pulleys 17A and 17B. Thus, while the upper printing table 11 is moved forth from the introducing section 2 toward the printing section 3, the lower printing table 12 is moved back from the printing section 3 toward the introducing section 2. The forth movement of the upper printing table 11 is maintained at the upper level. On the other hand, during the back movement of the lower printing table 12, it is moved downward from the upper level to the lower level, and is then next moved upward from the lower level to the upper level due to the guide grooves 35 of the guide bar members 34. Thus, although the lower printing table 12 meets the upper printing table 11 between the introducing section 2 and the printing section 3, the lower printing table 12 moving at the lower level can pass by the upper printing table 11 moving at the upper level without any collision therebetween. As soon as the lower printing table 12 has reached the upper level, the driving of the electric servomotor 15 is halted so that the lower printing table 12 is stopped at the upper level in the introducing section 2. Simultaneously, the upper printing table 11 is stopped in the printing section 3.

Similar to the case as mentioned above, the aligning device 5 is driven with the assistance of the CCD camera unit 7 so that both the squeegee unit 4 and the printing frame 6 are precisely and accurately positioned with respect to the unprocessed workpiece W set on the upper printing table 11, and then the squeegee unit 4 is driven so that paste patterns are printed on the workpiece W. On the other hand, in the introducing section 2, the processed workpiece W is unloaded from the lower printing table 12, and then an unprocessed workpiece W is loaded into and set on the lower printing table 12.

As is apparent from the foregoing, the unloading of the processed workpiece W from each of the upper and lower printing tables 11 and 12, the loading of a unprocessed workpiece W into each of the upper and lower printing tables 11 and 12 and the setting of the unprocessed workpiece W on each of the upper and lower printing tables 11 and 12 can be always carried out at the same upper level in the workpiece introducing section 2 by a worker. Also, since the unprocessed workpiece W set on each of the upper and lower printing tables 11 and 12 is always located at the same upper level, the unprocessed workpiece W on each of the upper and lower printing tables 11 and 12 can be subjected to the screen printing process in the same control manner.

MODIFICATIONS

In the above-mentioned embodiment, although the lower printing table 12 is moved downward from the first upper level to the second lower level so that the lower printing table 12 can pass by the upper printing table 11 during the back-and-forth movement of the lower printing table 12, the lower printing table 12 may only be horizontally moved back and forth without being vertically moved, and the upper printing table 12 may be moved upward and downward during the back-and-forth movement of the upper printing table 12, so that the lower printing table 12 can pass by the upper printing table 11 during the back-and-forth movement of the lower printing table 12.

In particular, in this modified embodiment described above, the aforesaid first and second levels are defined as respective lower and upper levels, and the upper printing table 11 includes four vertical movement guide mechanisms, similar to the vertical movement guide mechanisms 30A, 30B, 30C and 30D, which are provided under the respective corner areas of the upper printing table 11, so that the upper printing table 11 is vertically moved upward from the first level or lower level to the second level or upper level when being horizontally moved from one of the introducing and printing sections 2 and 3 toward the other section, and so that the upper printing table 11 is vertically moved downward from the second level or upper level to the first level or lower level when reaching the other section 2 or 3.

In the above-mentioned embodiment, it is preferable to provide the drive pulley 17A in the introducing section 2, because the drive source or electric servomotor 16 for driving the drive pulley 17A, which occupies a relatively large space, should be provided not in the printing section 3 in which the various elements are provided as stated above, but in the introducing section 2. Nevertheless, both the drive pulley 17A and the electric servomotor 16 may be provided in the printing section 3, if necessary, with the tension pulley 17B being provided in the introducing section 2.

In the above-mentioned embodiment, although the vertical moving system comprises the four vertical movement guide mechanisms 30A, 30B, 30C and 30D, one of them may be omitted from the vertical moving system. For example, when one of the vertical movement guide mechanisms 30A and 30B is omitted, the remaining upward-and-downward guiding mechanism 30A or 30B is provided at the center between the front corners of the lower printing table 12, and the guide bar member 34 for the remaining upward-and-downward guiding mechanism 30A or 30B is provided along a center line between the guide bar members 34 for the upward-and-downward guiding mechanism 30C and 30D. On the other hand, one of the vertical movement guide mechanisms 30C and 30D may be omitted. In this case, the remaining upward-and-downward guiding mechanism 30C or 30D is provided at the center between the rear corners of the lower printing table 12, and the guide bar member 34 for the remaining upward-and-downward guiding mechanism 30C or 30D is provided along a center line between the guide bar members 34 for the upward-and-downward guiding mechanism 30A and 30B.

It should be understood by those skilled in the art that the foregoing description is of preferred embodiments of the method and the device, and that various changes and modifications may be made to the present invention without departing from the spirit and scope thereof.

What is claimed is:

1. A method of moving a first printing table and a second printing table between a workpiece introducing section and a workpiece printing section of a screen printing apparatus, which method comprises the steps of:

locating said first printing table in position in a first one of a workpiece introducing section and workpiece printing section at a first level;

locating said second printing table in position in an other section of the workpiece introducing section and workpiece printing section at the first level;

moving said first printing table in a horizontal direction from said one of said workpiece introducing section and workpiece printing section to the other section of the workpiece introducing section and workpiece printing section; and moving said second printing table in a horizontal direction at the first level from said other section of the workpiece introducing section and workpiece printing section to said first one of said workpiece introducing section and workpiece printing section, wherein, during the movement of said first printing table from said first one of said workpiece introducing section and workpiece printing section to said other section of the workpiece introducing section and workpiece printing section, said first printing table is vertically moved from the first level to a second level that is different from the first level so that said first printing table can pass by said second printing table without any collision therebetween, and then is vertically moved from the second level to the first level before said first printing table reaches said other section.

2. The method as set forth in claim 1, wherein the moving of said first printing table from said first one of said workpiece introducing section and workpiece printing section to said other section of the workpiece introducing section and workpiece printing section and a step of moving said second printing table from said other section to said one of said workpiece introducing section and workpiece printing section are simultaneously performed.

3. The method as set forth in claim 1, wherein said first one of said workpiece introducing section and workpiece printing section is employed as a workpiece introducing section in which a processed workpiece is unloaded from each of said first and second printing tables located in said workpiece introducing section, and in which wherein a processed workpiece is loaded into each of said first and second printing tables located in said workpiece introducing section, and wherein said other section of the workpiece introducing section and workpiece printing section is employed as a workpiece printing section in which an unprocessed workpiece loaded into each of said first and second printing tables is subjected to screen printing.

4. The method as set forth in claim 1, wherein the first level is employed as an upper level and the second level are employed as an upper level and a lower level respectively, wherein the lower level is located inferior to the upper level, and wherein the vertical movement of said first printing table is employed in an upward-and-downward movement between the upper level and the lower level.

5. A table driving unit adapted for use in a screen printing apparatus having two working sections, said unit comprising:

a first printing table located in position in one of two working sections at a first level, and horizontally movable from said one of said two working sections to the other section of said two working sections;

a second printing table located in position in the other section of said two working sections and horizontally moveable at a first level from said other section to said one of said two working sections during horizontal movement of said first printing table from said one of said two working sections to said other section of the two working sections;

a horizontal movement system for moving said first and second printing tables back and forth between said two working sections whereby said first printing table is located in position in a first one of said two working sections at a first level and is horizontally movable from said first one of said two working sections to the other working section of said working sections, and wherein said second printing table is located in position in the other working section of said working sections and is horizontally moveable at the first level from said other section to said one of said two working sections during horizontal movement of said first printing table from said first one of said two working sections to said other section of said working sections and a vertical moving system provided in said first printing table to vertically move the first printing table from the first level to a second level different from the first level, so that said first printing table can pass by said second printing table without any collision therebetween, and whereby said first printing table is vertically moved from the second level to the first level before said first printing table reaches the other section.

6. The table driving unit as set forth in claim 5, wherein the movement of said first printing table from said one of said two working sections to said other section and the movement of said second printing table from said other section to said one of said two working sections are simultaneously performed.

7. The table driving unit as set forth in claim 5, wherein said one of said two working sections is employed as a workpiece introducing section which a processed workpiece is unloaded from each of said first and second printing tables located in said workpiece introducing section, and in which an unprocessed workpiece is loaded into each of said first and second printing tables located in said workpiece introducing section, and wherein said other working section is a printing section in which an unprocessed workpiece loaded into each of said first and second printing tables is subjected to screen printing.

8. The table driving unit as set forth in claim 5, wherein the first and second levels are employed as an upper level and a lower level, respectively, the lower level located inferior to the upper level, and wherein the vertical movement of said first printing table is employed as an upward-and-downward movement between the upper level and the lower level.

9. The table driving unit as set forth in claim 5, wherein the vertical moving system comprises a plurality of vertical movement guide mechanisms provided beneath said first printing table, each of said vertical movement guide mechanisms including:

a guide block member connected to a corresponding running section of an endless driving belt wherein the guide block member comprises a vertical guide slot formed therein;

an elongated member suspended from the bottom of said first printing table wherein the elongated member is slidably received in said vertical guide slot of said guide block member;

a cam follower provided at a lower end of the elongated member; and a cam bar member engaged with said cam follower to cause vertical movement of said first printing table between the first and second levels during back-and-forth movement of said first printing table between said two working sections.

10. The table driving unit as set forth in claim 9, wherein said cam bar member is formed with a cam groove, and wherein said cam follower is employed as a cam follower roller fitted into said cam groove of said cam bar member.

11. The table driving unit as set forth in claim 9, wherein said vertical moving system comprises four vertical movement guide mechanisms, and wherein said first printing table has a rectangular configuration, said four vertical movement guide mechanisms being provided on four corner areas of said first printing table, respectively.

12. The table driving unit as set forth in claim 9, wherein said cam bar member has a cam groove including a first flat end section, a first slant section gradually descending from said first flat end section, a flat bottom section extending from said first slant section, a second slant section gradually ascending from said flat bottom section, and a second flat end section extending from the second slant section, said first printing table located at the first level when said cam followers of the vertical movement guide mechanism are engaged with either said first flat end sections or said second flat end sections, said first printing table located at the second level when said cam followers of said vertical movement guide mechanisms are engaged with said flat bottom section.

13. The table driving unit as set forth in claim 12, wherein each of said cam grooves is symmetrical with respect to a geometrical line passing through the center thereof.

14. A table driving unit for alternately moving a first printing table and a second printing table between two working sections in a screen printing apparatus, said table driving unit comprising:

a horizontal movement system for moving said first and second printing table back and forth between said two working sections whereby said first printing table is located in position in a first one of said two working sections at a first level and is horizontally movable from said first one of said two working sections to the other working section of said two working sections, and wherein said second printing table is located in position in the other working section of said two working sections and is horizontally moveable at the first level from said other section to said one of said two working sections during horizontal movement of said first printing table from said first one of said two working sections to said other section of said two working sections; and a vertical moving system present in said first printing table to vertically move the first printing table from the first level to a second level which is different from the first level to enable said first printing table to pass by said second printing table without any collision therebetween, and to enable said first printing table to vertically move from the second level to the first level before said first printing table reaches said other section of said working sections.

15. The table driving unit as set forth in claim 14, wherein the movement of said first printing table from said one of said two working sections to said other working section of said two working sections and the movement of said second printing table from said other working section to said first one of said two working sections are simultaneously performed by said horizontal movement system.

16. The table driving unit as set forth in claim 14, wherein said first one of said two working sections is employed as an introducing section in which a processed workpiece is unloaded from each of said first and second printing tables located in said introducing section, and in which an unprocessed workpiece is loaded into each of said first and second printing tables located in said introducing section, and wherein said other section is employed as a printing section in which an unprocessed workpiece loaded into each of said first and second printing tables is subjected to a screen printing process.

17. The table driving unit as set forth in claim 14, wherein the first and second levels are employed as an upper level and a lower level, respectively, the lower level located inferior to the upper level, and wherein the vertical movement of said first printing table is defined as an upward-and-downward movement between the upper level and the lower level.

18. The table driving unit as set forth in claim 14, wherein said horizontal movement system includes:

a drive source present in said first one of said two working sections;

a drive pulley present in a first one of said two working sections, and operationally connected to said drive source;

a tension pulley present in an other working section of said two working sections; and an endless driving belt entrained by said drive and tension pulleys so as to extend between said two working sections, wherein said first and second printing tables are operatively connected with two running sections of said endless driving belt, respectively, so as to move said first and second printing tables back and forth between said two working sections.

19. The table driving unit as set forth in claim 18, wherein said horizontal movement system further comprises:

at least one first table joint member connected to one of said two running sections of said endless driving belt with which said first printing table is connected;

a guide block member connected to said at least one first table joint member, wherein said guide block member is vertically and slidably engaged with an elongated member vertically suspended from said first printing table; and at least one second table joint member connected to an other of said two sections of said endless driving belt with which said second printing table is connected, wherein at least one second table joint member is connected to said second printing table.

20. The table driving unit as set forth in claim 18, wherein said vertical moving system comprises at least three vertical movement guide mechanisms located on the bottom of said first printing table (12), each of said vertical movement guide mechanisms comprising:

a guide block member connected to a corresponding running section of said endless driving belt wherein the guide block member includes a vertical guide slot formed therein;

an elongated member suspended from the bottom of said first printing table, wherein the elongated member is slidably received in said vertical guide slot of said guide block member;

a cam follower located at a lower end of said elongated member; and a cam bar member engaged with said cam follower to cause vertical movement of said first printing table between the first and second levels during the back-and-forth movement of said first printing table between said two working sections.

21. The table driving unit as set forth in claim 20, wherein said cam bar member includes a cam groove, and wherein said cam follower is employed as a cam follower roller that is fitted into said cam groove of said cam bar member.

22. The table driving unit as set forth in claim 20, wherein said vertical moving system comprises four vertical movement guide mechanisms, and wherein said first printing table has a rectangular configuration, said four vertical movement guide mechanisms being provided on four corner areas at the bottom of said first printing table, respectively.

23. The table driving unit as set forth in claim 20, wherein said cam bar member has a cam groove that includes a first flat end section, a first slant section gradually descending from said first flat end section, a flat bottom section extending from said first slant section, a second slant section gradually ascending from the flat bottom section, and a second flat end section extending from said second slant section, said first printing table located at the first level when said cam followers of said vertical movement guide mechanisms are engaged with either said first flat end sections or said second flat end sections, said first printing table located at the second level when said cam followers of said vertical movement guide mechanisms are engaged with said flat bottom section.

24. The table driving unit as set forth in claim 23, wherein each of said cam grooves is symmetrical with respect to a geometrical line passing through the center thereof.

* * * * *